US009067328B2

(12) United States Patent
Saito et al.

(10) Patent No.: US 9,067,328 B2
(45) Date of Patent: Jun. 30, 2015

(54) CUTTING DEVICE AND METHOD OF PRODUCTION OF CLEANING MEMBER USING CUTTING DEVICE

(71) Applicant: UNICHARM CORPORATION, Ehime (JP)

(72) Inventors: Kunihiko Saito, Kanonji (JP); Shigetomo Takahashi, Kanonji (JP); Kazuhiko Hoshika, Kanonji (JP); Hisaoki Nobukuni, Kanonji (JP)

(73) Assignee: UNICHARM CORPORATION, Ehime (JP)

( * ) Notice: Subject to any disclaimer, the term of this patent is extended or adjusted under 35 U.S.C. 154(b) by 149 days.

(21) Appl. No.: 13/749,714

(22) Filed: Jan. 25, 2013

(65) Prior Publication Data

US 2014/0182429 A1 Jul. 3, 2014

(30) Foreign Application Priority Data

Dec. 29, 2012 (JP) ..... 2012-289178

(51) Int. Cl.

| | |
|---|---|
| ***B26D 5/20*** | (2006.01) |
| ***B26D 1/18*** | (2006.01) |
| ***B26D 1/11*** | (2006.01) |
| ***B26D 1/16*** | (2006.01) |

(Continued)

(52) U.S. Cl.

CPC ..... *B26D 1/11* (2013.01); *Y10T 83/4473* (2015.04); *Y10T 83/0586* (2015.04); *B26D 5/20* (2013.01); *B26D 1/16* (2013.01); *B26D 7/0625* (2013.01); *B26D 11/00* (2013.01)

(58) Field of Classification Search

USPC ..... 83/52, 42, 213, 202, 471.2, 484, 469, 83/493

See application file for complete search history.

(56) References Cited

U.S. PATENT DOCUMENTS

| | | | |
|---|---|---|---|
| 345,644 | A | 7/1886 | Moseman |
| 470,898 | A | 3/1892 | Reiffel |

(Continued)

FOREIGN PATENT DOCUMENTS

| | | |
|---|---|---|
| EP | 0546580 | 6/1993 |
| EP | 2009152 | 12/2008 |

(Continued)

OTHER PUBLICATIONS

International Search Report and Written Opinion Mailed Feb. 18, 2014, corresponds to International Application No. PCT/JP2013/085203.

(Continued)

*Primary Examiner* — Sean Michalski

(74) *Attorney, Agent, or Firm* — Lowe Hauptman & Ham, LLP

(57) ABSTRACT

The invention relates to a cutting device which cuts a web member, which includes fiber bundles which extend continuously in a machine direction MD and which is intermittently conveyed in said machine direction, in a crossing direction CD which crosses the machine direction. The cutting device has a plurality of disk shaped rotary blades which rotate about rotary shafts which extend along the machine direction while moving in said cross direction so as to thereby cut said web member when the web member is at a stop. The plurality of rotary blades are arranged so as to be substantially aligned in the crossing direction and includes a rotary blade which rotates in one direction and a rotary blade which rotates in the opposite direction.

5 Claims, 9 Drawing Sheets

(51) Int. Cl.
*B26D 11/00* (2006.01)
*B26D 7/06* (2006.01)

(56) References Cited

U.S. PATENT DOCUMENTS

| | | | | |
|---|---|---|---|---|
| 1,847,065 | A | 2/1932 | Munch | |
| 2,733,064 | A | 1/1956 | Martin | |
| 2,738,973 | A | 3/1956 | Koch | |
| 2,836,418 | A | 5/1958 | Blattner et al. | |
| 2,904,335 | A | 9/1959 | Rabinow | |
| 2,960,023 | A | 11/1960 | Greiner et al. | |
| 3,022,999 | A | 2/1962 | Mead | |
| 3,362,707 | A | 1/1968 | Unto | |
| 3,370,848 | A | 2/1968 | Bartlett | |
| 3,376,609 | A | 4/1968 | Kalwaites | |
| 3,566,451 | A | 3/1971 | Weigand | |
| 3,592,373 | A | 7/1971 | Wyatt et al. | |
| 3,724,037 | A | 4/1973 | Nicholson et al. | |
| 3,737,950 | A | 6/1973 | Bolliand et al. | |
| 3,840,941 | A | 10/1974 | Neveu | |
| 3,860,127 | A | 1/1975 | Fassman | |
| 3,907,128 | A | 9/1975 | Cathers | |
| 3,912,258 | A | 10/1975 | Martin | |
| 3,966,196 | A | 6/1976 | Simeth | |
| 4,190,241 | A | 2/1980 | Krueger | |
| 4,319,744 | A | 3/1982 | Nagel et al. | |
| 4,385,757 | A | 5/1983 | Muller | |
| 4,514,128 | A | 4/1985 | Hedrick | |
| 4,640,161 | A * | 2/1987 | Kurk | 83/104 |
| 4,664,368 | A | 5/1987 | Bouwens et al. | |
| 4,961,805 | A | 10/1990 | Siebert | |
| 5,060,929 | A | 10/1991 | Kohlmann | |
| 5,230,764 | A * | 7/1993 | Moll | 156/256 |
| 5,241,731 | A | 9/1993 | Stuart | |
| 5,253,762 | A | 10/1993 | Duncan | |
| 5,332,210 | A | 7/1994 | Silverberg et al. | |
| 5,355,567 | A | 10/1994 | Holliday | |
| 5,417,912 | A | 5/1995 | Merry | |
| 5,431,530 | A | 7/1995 | Kobayashi et al. | |
| 5,435,541 | A | 7/1995 | Fornay et al. | |
| 5,516,091 | A | 5/1996 | Nakayama | |
| 5,535,576 | A | 7/1996 | Walintschek | |
| 5,779,432 | A | 7/1998 | Pena | |
| 6,286,403 | B1 | 9/2001 | Rosenthal et al. | |
| 6,491,492 | B1 | 12/2002 | Cook | |
| 6,494,450 | B2 | 12/2002 | Tsurumaki | |
| 6,554,937 | B1 | 4/2003 | Kenmochi et al. | |
| 6,572,101 | B2 | 6/2003 | Kaya et al. | |
| 6,780,264 | B2 | 8/2004 | Nakata et al. | |
| 7,003,856 | B2 | 2/2006 | Hayashi et al. | |
| 7,156,011 | B2 * | 1/2007 | Morris et al. | 83/876 |
| 7,300,053 | B2 | 11/2007 | Asano | |
| 7,339,675 | B2 | 3/2008 | Nishida et al. | |
| 7,571,524 | B2 | 8/2009 | Kawabe et al. | |
| 8,100,038 | B2 * | 1/2012 | Sandahl | 83/26 |
| 8,201,429 | B1 * | 6/2012 | Matsunaga | 72/161 |
| 8,357,415 | B2 | 1/2013 | Furusawa | |
| 8,448,335 | B2 * | 5/2013 | Lundgren et al. | 29/890.01 |
| 2002/0026699 | A1 | 3/2002 | Hayashi et al. | |
| 2002/0148061 | A1 | 10/2002 | Tanaka et al. | |
| 2003/0000934 | A1 | 1/2003 | Tanaka et al. | |
| 2003/0127177 | A1 | 7/2003 | Lane | |
| 2003/0172506 | A1 | 9/2003 | Guirman et al. | |
| 2004/0149095 | A1 | 8/2004 | Miyatake et al. | |
| 2005/0005381 | A1 | 1/2005 | Tanaka et al. | |
| 2005/0039285 | A1 | 2/2005 | Tanaka et al. | |
| 2005/0066496 | A1 | 3/2005 | Ames et al. | |
| 2005/0097695 | A1 | 5/2005 | Tanaka et al. | |
| 2005/0097696 | A1 | 5/2005 | Tanaka et al. | |
| 2005/0132521 | A1 | 6/2005 | Tanaka et al. | |
| 2005/0139513 | A1 | 6/2005 | Miller | |
| 2005/0177967 | A1 | 8/2005 | Tanaka et al. | |
| 2005/0188490 | A1 | 9/2005 | Tanaka et al. | |
| 2005/0193514 | A1 | 9/2005 | Tanaka et al. | |
| 2005/0198760 | A1 | 9/2005 | Tanaka et al. | |
| 2005/0258589 | A1 | 11/2005 | Michler et al. | |
| 2006/0005675 | A1 * | 1/2006 | Scheffer et al. | 83/37 |
| 2006/0016035 | A1 | 1/2006 | Tanaka et al. | |
| 2006/0016036 | A1 | 1/2006 | Tanaka et al. | |
| 2006/0048325 | A1 | 3/2006 | Tsuchiya | |
| 2006/0051434 | A1 | 3/2006 | Tsuchiya | |
| 2006/0101601 | A1 | 5/2006 | Fujiwara et al. | |
| 2006/0156876 | A1 * | 7/2006 | Sussmeier et al. | 83/13 |
| 2006/0179989 | A1 * | 8/2006 | James et al. | 83/284 |
| 2007/0068353 | A1 * | 3/2007 | Piucci et al. | 83/311 |
| 2009/0049633 | A1 | 2/2009 | Takabayashi et al. | |
| 2009/0165230 | A1 | 7/2009 | Tsuchiya et al. | |
| 2009/0172904 | A1 | 7/2009 | Tsuchiya et al. | |
| 2009/0196538 | A1 | 8/2009 | Liou et al. | |
| 2009/0255078 | A1 | 10/2009 | Wada et al. | |
| 2010/0000382 | A1 * | 1/2010 | Maddalon | 83/13 |
| 2010/0022978 | A1 | 1/2010 | Kasai et al. | |
| 2010/0058907 | A1 * | 3/2010 | Kern | 83/86 |
| 2010/0122613 | A1 * | 5/2010 | Sandahl | 83/13 |
| 2010/0154156 | A1 | 6/2010 | Takabayashi et al. | |
| 2010/0180745 | A1 * | 7/2010 | Hall | 83/745 |
| 2011/0138942 | A1 | 6/2011 | Murata | |
| 2011/0296965 | A1 * | 12/2011 | Manek-Honninger et al. | 83/27 |
| 2012/0132046 | A1 * | 5/2012 | Supe-Dienes | 83/51 |
| 2012/0135227 | A1 | 5/2012 | Kawabe | |
| 2012/0167736 | A1 | 7/2012 | Yokoe | |
| 2014/0182429 | A1 * | 7/2014 | Saito et al. | 83/52 |

FOREIGN PATENT DOCUMENTS

| | | | |
|---|---|---|---|
| JP | 45-35382 | | 11/1970 |
| JP | 488917 | | 10/1973 |
| JP | 53-45414 | | 4/1978 |
| JP | 56169873 | A | 12/1981 |
| JP | 3-33222 | | 2/1991 |
| JP | 5245090 | A | 9/1993 |
| JP | 5-279950 | | 10/1993 |
| JP | 5-316909 | | 12/1993 |
| JP | 8-49126 | | 2/1996 |
| JP | 8-259274 | | 10/1996 |
| JP | 10-110346 | | 4/1998 |
| JP | 11323718 | A | 11/1999 |
| JP | 2000296083 | A | 10/2000 |
| JP | 2001246595 | A | 9/2001 |
| JP | 2001-288639 | | 10/2001 |
| JP | 2002069781 | A | 3/2002 |
| JP | 2003265390 | A | 9/2003 |
| JP | 2003268663 | A | 9/2003 |
| JP | 2004223692 | A | 8/2004 |
| JP | 2005040641 | A | 2/2005 |
| JP | 2005046645 | A | 2/2005 |
| JP | 2005095665 | A | 4/2005 |
| JP | 2005111284 | A | 4/2005 |
| JP | 2005137929 | A | 6/2005 |
| JP | 2005137930 | A | 6/2005 |
| JP | 2005137931 | A | 6/2005 |
| JP | 2005144198 | A | 6/2005 |
| JP | 2005169148 | A | 6/2005 |
| JP | 2005199077 | A | 7/2005 |
| JP | 2005230573 | A | 9/2005 |
| JP | 2005237975 | A | 9/2005 |
| JP | 2006015164 | A | 1/2006 |
| JP | 2006034990 | A | 2/2006 |
| JP | 2006-152485 | | 6/2006 |
| JP | 2006-166931 | | 6/2006 |
| JP | 2006141483 | A | 6/2006 |
| JP | 2006-265762 | A | 10/2006 |
| JP | 2007002390 | A | 1/2007 |
| JP | 2007029135 | A | 2/2007 |
| JP | 2007029136 | A | 2/2007 |
| JP | 2007111297 | A | 5/2007 |
| JP | 2007135666 | A | 6/2007 |
| JP | 2007135774 | A | 6/2007 |
| JP | 2007136156 | A | 6/2007 |
| JP | 2007159612 | A | 6/2007 |
| JP | 2007209460 | A | 8/2007 |

(56) References Cited

FOREIGN PATENT DOCUMENTS

| | | | |
|---|---|---|---|
| JP | 2007209461 | A | 8/2007 |
| JP | 2007236690 | A | 9/2007 |
| JP | 2007-283086 | | 11/2007 |
| JP | 2008006260 | A | 1/2008 |
| JP | 2008119171 | A | 5/2008 |
| JP | 2009153914 | A | 7/2009 |
| JP | 2010-24575 | | 2/2010 |
| JP | 2011-062802 | A | 3/2011 |
| JP | 4675218 | B2 | 4/2011 |
| JP | 2011084313 | A | 4/2011 |
| JP | 4738311 | B2 | 8/2011 |
| JP | 4878988 | B2 | 2/2012 |
| JP | 2012-115783 | A | 5/2012 |
| KR | 20110137660 | | 12/2011 |
| WO | 2007/023965 | | 3/2007 |

OTHER PUBLICATIONS

International Search Report and Written Opinion Mailed Mar. 25, 2014, corresponds to International Application No. PCT/JP2013/085170.

International Search Report and Written Opinion Mailed Feb. 18, 2014, corresponds to Internation Application No. PCT/JP2013/085179.

Office Action mailed Jan. 15, 2015, corresponding to U.S. Appl. No. 13/749,721.

Office Action mailed Apr. 29, 2015, corresponding to U.S. Appl. No. 13/749,717.

Office Action mailed Apr. 27, 2015, corresponding to U.S. Appl. No. 13/749,726.

* cited by examiner

CUTTING DEVICE AND METHOD OF PRODUCTION OF CLEANING MEMBER USING CUTTING DEVICE

RELATED APPLICATIONS

The present application is based on, and claims priority from, Japanese Application Number 2012-289178, filed Dec. 29, 2012, the disclosure of which is hereby incorporated by reference herein in its entirety.

TECHNICAL FIELD

The present invention relates to a cutting device and a method of production of a cleaning member using said cutting device.

BACKGROUND ART

A device which cuts a web member, which has a plurality of fibers including tows along a machine direction and which continues in said machine direction, at intervals in said machine direction, said cutting device of a web member characterized by having an intermittent conveyance mechanism which intermittently conveys said web member in said machine direction, a disk shaped rotary blade which rotates about a rotary shaft along said machine direction while moving in a crossing direction which crosses said machine direction while said web member has stopped being conveyed so as to cut said web member, and a downstream side pushing member which pushes said web member against said intermittent conveyance mechanism so as to limit movement of said web member at a position at the downstream side of a cutting position in said machine direction while said rotary blade is cutting said web member has already been invented (see PTL 1).

If using the above-mentioned such cutting device, it is possible to secure good cuttability compared with a cutting device which cuts a web member by pressure between a cutting blade and receiving blade like in a cutting device of PTL 2.

CITATIONS LIST

Patent Literature

PTL 1 Japanese Patent Application No. 2012-115783
PTL 2 Japanese Patent Publication No. 2011-62802

SUMMARY OF INVENTION

Technical Problem

However, if said cutting device includes a single rotary blade, the force received by the cutting edge of the rotary blade is applied to the web member from one direction and, at the time of cutting, the cut end at the cut surface included in the web member ends up being turned in that one direction. As a result, insufficiently cut fibers are liable to be formed and the cut surface may not become a clean one.

Therefore, an object of the present invention is to provide a cutting device which reduces the insufficiently cut fibers when cutting a web member while forming a clean cut surface and to provide a method of producing a cleaning member which has a clean cut surface.

Solution to Problem

To achieve this object, according to the present invention, there is provided a cutting device which cuts a web member, which includes a fiber bundle which extends continuously in a machine direction and which is intermittently conveyed in said machine direction, in a crossing direction which crosses said machine direction, said cutting device having a plurality of disk shaped rotary blades which rotate about rotary shafts which extend along said machine direction while moving in said crossing direction so as to thereby cut said web member when said web member is at a stop, said plurality of rotary blades being arranged so as to be substantially aligned in said crossing direction and including a rotary blade which rotates in one direction and a rotary blade which rotates in the opposite direction.

Furthermore, to achieve said object, according to the present invention, there is provided a method of producing a cleaning member which includes a fiber bundle, said method including a step of using the above-mentioned cutting device to cut said web member which includes a fiber bundle which extends in a machine direction.

Advantageous Effects of Invention

According to the cutting device according to the present invention, it is possible to provide a cutting device which reduces the insufficiently cut fibers when cutting a web member while forming a clean cut surface. Furthermore, according to the method of producing a cleaning member according to the present invention, it is possible to produce a cleaning member which has a clean cut surface.

DESCRIPTION OF EMBODIMENTS (Cleaning Member Produced by Method of Production According to Embodiment)

Figure 1:
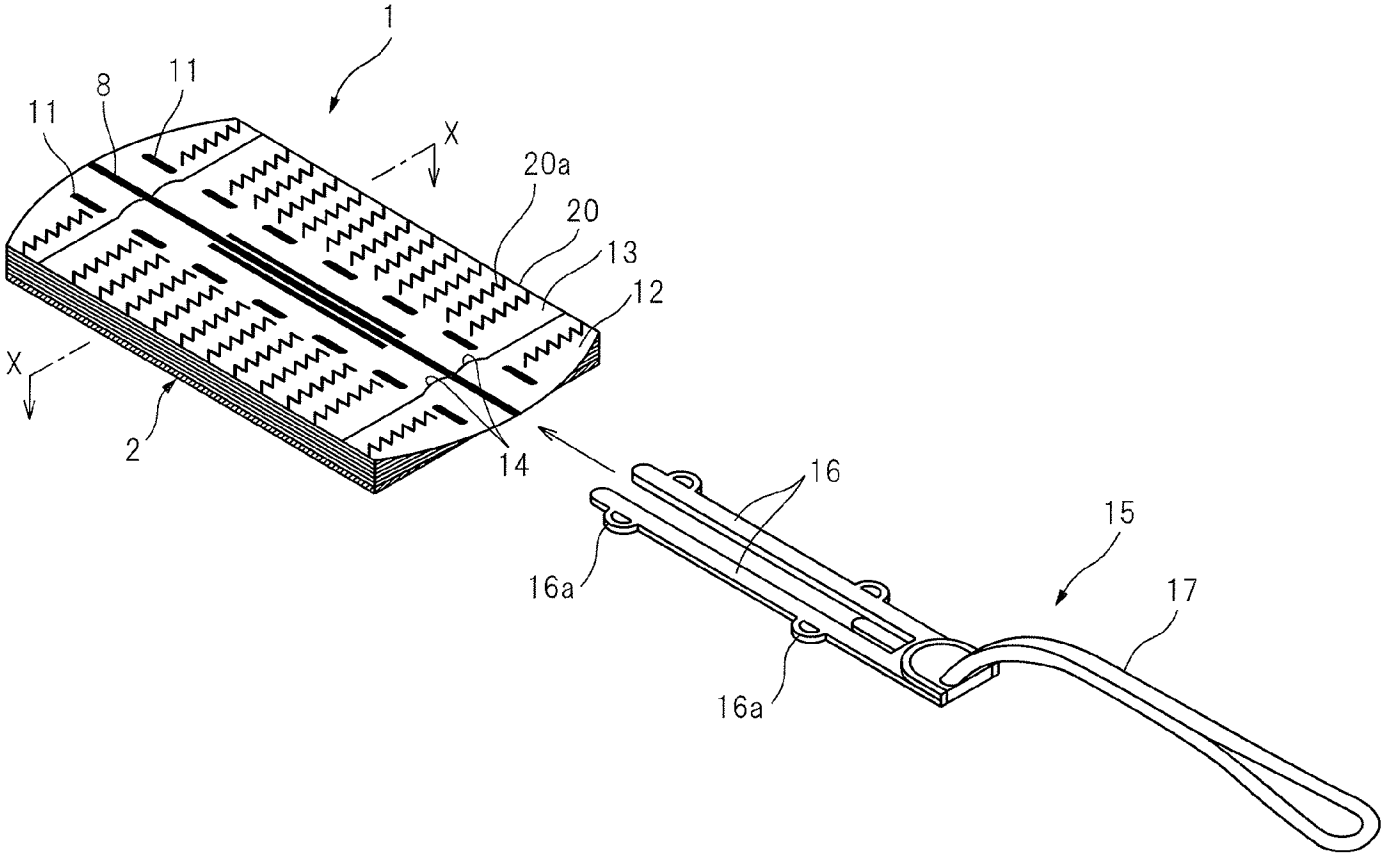
FIG. 1 is a perspective view which shows a cleaning member and a handle which is produced by a method of production according to one embodiment of the present invention.
Figure 2:
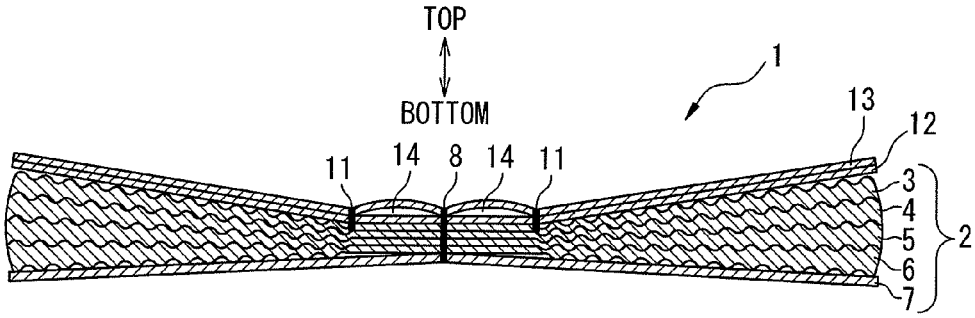
FIG. 2 is a cross-sectional view along the line X-X of FIG. 1.
Figure 3:
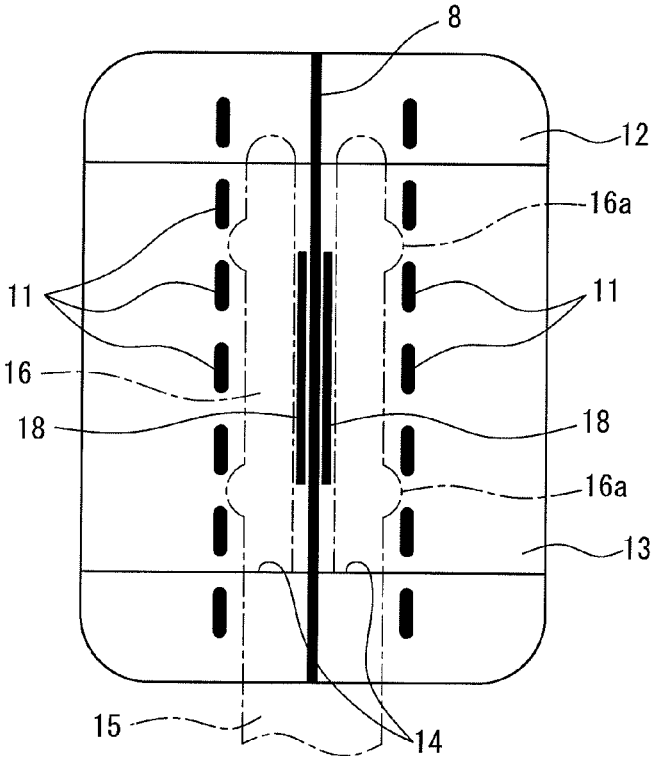
FIG. 3 is a plan view of a cleaning member of FIG. 1.

First, the configuration of a cleaning member 1 which is produced by the method of production according to one embodiment of the present invention and a handle 15 which is fastened to this cleaning member will be explained in brief. FIG. 1 to FIG. 3 show the configuration of the cleaning member 1 according to the present invention and handle 15, where FIG. 1 is a perspective view which shows the cleaning member 1 and handle 15 as a whole, FIG. 2 is a cross-sectional view along the line X-X of FIG. 1, and FIG. 3 is a plan view of a cleaning member 1 of FIG. 1.

That is, this cleaning member 1 is provided with a brush sheet (shaggy part) 2 which has a plurality of fibrous members 3, 4, 5, 6 and a sheet with slits 7 which is overlaid at the bottom part of the fibrous member 6, a substrate sheet 12 which is overlaid at the top part of the brush sheet 2, and a holding sheet 13 which is overlaid at the top part of the substrate sheet 12. Between the substrate sheet 12 and the holding sheet 13, receiving parts 14 are provided for receiving the insert parts 16 of the handle 15. Note that, when referring to FIG. 2, the top direction in FIG. 2 will be explained as "top" and the bottom direction as "bottom".

Note that, the cleaning member 1 is provided with two receiving parts 14 so as to enable insertion of two branched insert parts 16. However, the insert parts 16 may also be branched into three or more parts, or may not be branched. The cleaning member 1 is provided with the receiving parts 14 in accordance with the number of branches at the insert parts 16.

The brush sheet 2, as shown in FIG. 2, is provided with four-layer structure fibrous members 3 to 6 comprised of a first fibrous member 3, a second fibrous member 4 which is overlaid at the bottom part of the first fibrous member 3, a third fibrous member 5 which is overlaid at the bottom part of the second fibrous member 4, and a fourth fibrous member 6 which is overlaid at the bottom part of the third fibrous member 5 and with a sheet with slits 7 which is overlaid at the bottom part of the fourth fibrous member 6 of this four-layer structure fibrous members 3 to 6. Note that, the fibrous members of the brush sheet 2 are not limited to a four-layer structure and may also be a single layer, two-layer, three-layer, or five or more-layer structure. Further, in another embodiment, the brush sheet 2 is not provided with the sheet with slits 7.

The first fibrous member 3, second fibrous member 4, third fibrous member 5, and fourth fibrous member 6 of the brush sheet 2 are treated by dust catching oil comprised mainly of for example liquid paraffin having the action of promoting adsorption of dust, dirt, etc.

The first fibrous member 3, second fibrous member 4, third fibrous member 5, and fourth fibrous member 6 of the brush sheet 2 can be formed by a fiber bundle, for example, from tows by, for example, opening the tows.

Note that, in the Specification, a "tow", as described in JIS L 0204-3: 1998, section 3.1.24, means a bundle of an extremely large number of filaments aligned together.

As the fiber bundle, for example, a fiber bundle comprised of thermoplastic fibers, a fiber bundle including thermoplastic fibers, etc. may be mentioned. As the material of the fibers forming the fiber bundle, for example, polyethylene, polypropylene, polyethylene terephthalate, nylon, rayon, etc. may be mentioned.

As the fibers forming the fiber bundle, for example, monofilaments and composite fibers, for example, core-sheath type composite fibers or side-by-side type composite fibers etc. may be mentioned. As the composite fibers, core-sheath type composite fibers are preferable. Furthermore, core-sheath type composite fibers with a melting point of the core higher than the melting point of the sheath are more preferable from the viewpoint of thermal bondability.

As the core-sheath type composite fibers, core-sheath type composite fibers with a core comprised of polypropylene or polyethylene terephthalate and a sheath comprised of polyethylene are more preferable and further core-sheath type composite fibers with a core comprised of a polyethylene terephthalate and a sheath comprised of polyethylene are still more preferable.

The denier of the fibers which forms the fiber bundle is preferably 1 to 50 dtex, more preferably 2 to 10 dtex. The fiber bundle may include a plurality of types of fibers which have the same denier or may include one or more types of fibers which have different deniers.

The fiber bundle may also be a bundle of slit fibers (fibers obtained by cutting and stretching a film in an elongated manner), split fibers (fibers obtained by dividing an elongated film into a net structure), etc.

In the method of production according to the present embodiment, the fibers which form the fiber bundle are comprised of crimped fibers. By forming the fibers by crimped fibers, it is possible to increase the bulk of the fiber bundle and possible to make the crimped parts structures which easily take in dust, dirt, etc. In a method of production according to another embodiment, the fibers which form the fiber bundle are not crimped.

The sheet with slits 7, as explained later, in the same way as the substrate sheet 12 and holding sheet 13, is formed from a nonwoven fabric which is comprised of thermoplastic fibers (thermal bond fibers) or a nonwoven fabric which includes thermoplastic fibers and is formed into a rectangular shape of substantially the same width and substantially the same length as the substrate sheet 12. The sheet with slits 7 is provided with sawtooth shaped slits (not shown) at predetermined intervals across the entire sheet with slits 7. Due to the slits, across the entire length of the two edge parts in the width direction of the sheet with slits 7, the two edges are formed with sawtooth shaped reed-shaped parts (not shown).

As shown in FIG. 1 to FIG. 3, at the top part of the first fibrous member 3 of the brush sheet 2, the substrate sheet 12 and the holding sheet 13 are overlaid in that order. Between the substrate sheet 12 and the holding sheet 13, receiving parts 14 are provided for insertion of insert parts 16 of the handle 15.

The substrate sheet 12 and the holding sheet 13 have rectangular shapes. As shown in FIG. 3, the two sheets 12 and 13 are set to the same dimensions in the width direction (left-right direction of FIG. 3), while the substrate sheet 12 is set longer than the holding sheet 13 in dimension in the length direction (up-down direction of FIG. 3). The holding sheet 13 is overlaid on the top part of the substrate sheet 12 so that two end parts of the substrate sheet 12 in the long direction stick out outward from the two ends of the holding sheet 13 in the long direction by predetermined lengths.

The substrate sheet 12 and holding sheet 13 are formed from nonwoven fabrics which are comprised of thermoplastic fibers (thermal bond fibers) or nonwoven fabrics which include thermoplastic fibers. As thermoplastic fibers, for example, polyethylene fibers, polypropylene fibers, polyethylene terephthalate fibers, polyethylene and polyethylene terephthalate composite fibers, polyethylene and polypropylene composite fibers, core-sheath type composite fibers comprised, for example, of a core comprised of polyethylene terephthalate and a sheath comprised of polyethylene, etc. may be mentioned. As types of nonwoven fabrics, for example, thermal bond nonwoven fabrics, spunbonded nonwoven fabrics, spunlace nonwoven fabrics, etc. may be mentioned.

As other embodiments, embodiments in which the substrate sheet and the holding sheet are formed from thermoplastic resin films, for example, polyethylene films and polypropylene films, may be mentioned, while as further embodiments, embodiments in which the substrate sheet and the holding sheet are formed from laminate sheets of nonwoven fabrics and resin films may be mentioned.

The substrate sheet 12 and the holding sheet 13 are integrally melt bonded by a later explained first melt bonded part forming device 158 together with all of the layers of the brush sheet 2 (first fibrous member 3, second fibrous member 4, third fibrous member 5, fourth fibrous member 6, and sheet with slits 7), whereby the cleaning member 1, as shown in FIG. 1 to FIG. 3, is formed with a first melt bonded part 8 extending in the long direction at the center part in the width direction. Furthermore, the substrate sheet 12 and the holding sheet 13 are integrally melt bonded at the two sides of the first melt bonded part 8 (left and right in FIG. 2) by a later explained second melt bonded part forming device 134 together with one layer of the brush sheet 2 (first fibrous member 3), whereby the second melt bonded parts 11 are formed. Two second melt bonded parts 11 are respectively formed in a row intermittently in the long direction. By the first fibrous member 3 being melt bonded with the substrate sheet 12 and the holding sheet 13, the first fibrous member 3 tracks movement of these sheets 12 and 13, so in the state of use, the brush sheet 2 easily becomes broader and therefore the cleaning efficiency is improved.

The substrate sheet 12 and the holding sheet 13 are melt bonded at the first melt bonded part 8 with all layers of the brush sheet 2 (first fibrous member 3, second fibrous member 4, third fibrous member 5, fourth fibrous member 6, and sheet with slits 7) and is melt bonded with the first fibrous member 3 of the brush sheet 2 at the two second melt bonded parts 11. Due to this, between the substrate sheet 12 and the holding sheet 13, a pair of receiving parts 14 are formed comprised of bag-shaped spaces which are defined by the first melt bonded part 8 and the two second melt bonded parts 11, which extend in the long direction of the substrate sheet 12 and the holding sheet 13, and which are open at the two ends in the long directions. As a result, the receiving parts 14 can receive the insert parts 16 of the handle 15.

The substrate sheet 12 and the holding sheet 13 are melt bonded by a later explained second melt bonded part forming device 134 with the first fibrous member 3 of the brush sheet 2 at the center parts of these. A pair of melt bonding lines 18 are further formed at a predetermined interval in the width direction of the substrate sheet 12 and the holding sheet 13. Between the pair of melt bonding lines 18, the first melt bonded part 8 is formed. The pair of melt bonding lines 18 are marks for management of the position of the first melt bonded part 8 at the stage of production. By managing whether the first melt bonded part 8 is arranged between the pair of melt bonding lines 18 by sensors etc., it is possible to separate good products and bad products.

The two second melt bonded parts 11 are provided intermittently at several locations in the long directions of the substrate sheet 12 and the holding sheet 13. By engaging the arc shaped projections 16*a* of the insert parts 16 of the handle 15 with nonmelt bonded parts of the two second melt bonded part 11, the insert parts 16 of the handle 15 can be prevented from being pulled out from the receiving parts 14.

Further, the two edge parts of the substrate sheet 12 and the holding sheet 13 in the width direction (outside parts of two second melt bonded parts 11), as shown in FIG. 1, are provided with sawtooth shaped slits 20*a* at predetermined intervals along the long direction. Due to the slits 20*a*, the two edge parts are provided with sawtooth shaped reed-shaped parts 20. As another embodiment, an embodiment in which the substrate sheet 12 and the holding sheet 13 are not provided with sawtooth shaped slits 20*a* and therefore the reed-shaped parts 20 are not provided may be mentioned.

Note that the handle 15 is formed from a plastic etc. As shown in FIG. 1, it has a pair of rectangular plate shaped insert parts 16 which are arranged in parallel to each other, a pair of arc-shaped projections 16*a* which stick out from the outside surfaces of the two ends parts in the long directions of the insert parts 16, and a holder 17 which is provided integrally with one of the end parts of the insert parts 16.

By inserting the two insert parts 16 of the handle 15 inside the two receiving parts 14 of the cleaning member 1 configured in this way and respectively engaging the projections 16*a* with non-melt bonded parts of the two second melt bonded parts 11, the cleaning member 1 is attached to the handle 15.

Further, by holding the holder 17 of the handle 15, bringing the brush sheet 2 into contact with a location being cleaned, and making it move in the desired direction, the dust, dirt, etc. of the location being cleaned is trapped by the brush sheet 2 and therefore the location being cleaned is cleaned.

(Method of Production According to Embodiment)

Figure 4:
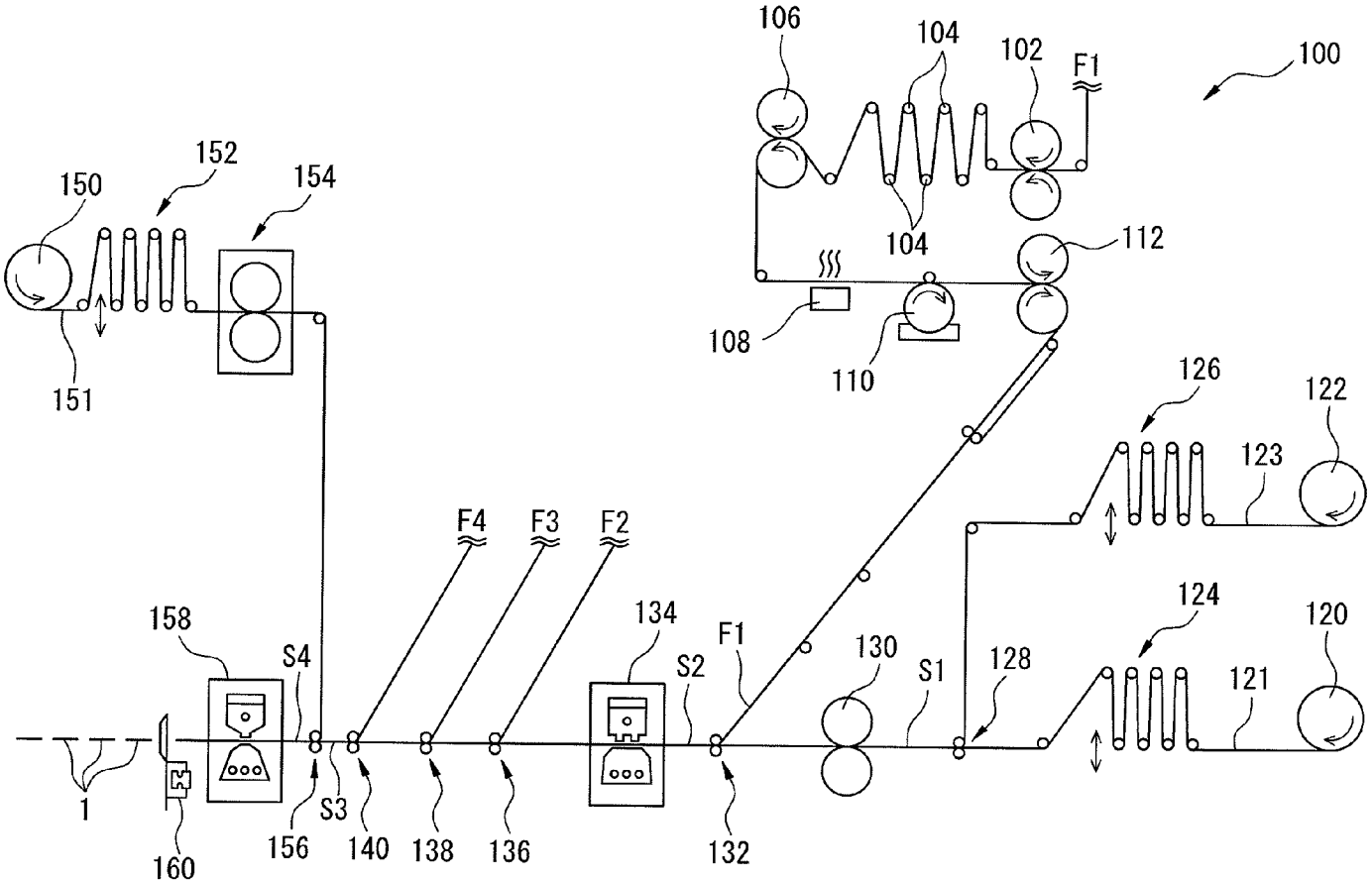
FIG. 4 is a schematic view for explaining a method of producing a cleaning member of FIG. 1.

Next, the method of production of the above-mentioned cleaning member 1 will be explained. FIG. 4 is a schematic view for explaining the method for producing the cleaning member 1 using a production system 100.

First, in the present embodiment, a crimped first fiber bundle F1 is taken out from a container (not shown) and is fed to first nip rolls 102. The first nip rolls 102 rotate at a certain peripheral velocity V1 whereby the first fiber bundle F1 is conveyed in the machine direction MD. After passing through the first nip rolls 102, the first fiber bundle F1 passes through the tension rolls 104 and reaches the second nip rolls 106.

The peripheral velocity V2 of the second nip rolls 106 is faster than the peripheral velocity V1 of the first nip rolls 102. Due to this, between these nip rolls 102 and 106, the first fiber bundle F1 is given tension. As a result, the first fiber bundle F1 is opened.

Here, the tension rolls 104, for example, are formed from solid steel so as to become heavier in mass. The mass of the tension rolls 104 means that a considerable degree of force is required to rotate the tension rolls 104 by their inertia. As a result, the speed of movement of the first fiber bundle F1 which turns the tension rolls 104 while advancing from the first nip rolls 102 toward the second nip rolls 106 does not rapidly increase.

The tension rolls 104 are arranged to be able to gradually open the first fiber bundle F1 by the stroke between the first nip rolls 102 and the second nip rolls 106 becoming longer.

The first fiber bundle F1 which has passed through the second nip rolls 106 passes through an air feeder 108 and oil applicator 110 and then reaches third nip rolls 112. The peripheral velocity V3 of the third nip rolls 112 is slower than the peripheral velocity V2 of the second nip rolls 106. Therefore, the first fiber bundle F1 which is positioned between the second nip rolls 106 and the third nip rolls 112 is eased in the tension which was imparted and, further, the first fiber bundle F1 is further opened and the width of the first fiber bundle F1 is expanded.

Between the second nip rolls 106 and the third nip rolls 112, the air feeder 108 is provided. Due to this, the first fiber bundle F1 is further opened.

Between the second nip rolls 106 and third nip rolls 112, the oil applicator 110 is further provided. The oil applicator 110 applies dust catching oil which has the action of promoting adsorption of dust, dirt, etc. to the first fiber bundle F1. The dust catching oil is, for example, oil mainly comprised of liquid paraffin.

The first fiber bundle F1 which has passed the third nip rolls 112 proceeds to the merging part 132 after ending the opening step.

On the other hand, the nonwoven fabric 121 which forms the substrate sheet 12 is continuously unrolled from a nonwoven fabric roll 120. The nonwoven fabric 121 passes through dancer rolls 124 which include a plurality of rolls arranged in two top/bottom stages and where the rolls which are positioned at the bottom stage rock up and down and then is intermittently conveyed in the machine direction MD. Here, "intermittently conveyed" means the nonwoven fabric 121 is repeatedly advanced by a certain distance, for example, substantially the width direction length of the cleaning member 1, in the MD direction, then stopped from being conveyed for a certain time. By the nonwoven fabric being intermittently conveyed in this way, it is possible to secure the time for melt bonding the component elements of the later explained multilayer web.

Similarly, the nonwoven fabric 123 which forms the holding sheet 13 is continuously unrolled from a nonwoven fabric roll 122. The nonwoven fabric 123 is passed through dancer rolls 126 which include a plurality of rolls arranged in two top/bottom stages and where the rolls which are positioned at the bottom stage rock up and down and is then intermittently conveyed.

The nonwoven fabrics 121, 123 merge at the merging part 128 to form a multilayer web S1. The multilayer web S1 passes the gather cutters 130 which have sawtooth shaped blades (not shown) intermittently formed at their surfaces in the peripheral direction. Due to this, the slits 20*a* which are shown in FIG. 1 are formed at the substrate sheet 12 and the holding sheet 13. In the method of production according to the present embodiment, the substrate sheet 12 and the holding sheet 13 are positioned at the bottommost layers of the later explained multilayer webs S1 to S4 and support other layers. (That is, the up-down direction are opposite to FIG. 2.)

Next, the multilayer web S1 merges at the merging part 132 with the above-mentioned fiber bundle F1 to form the multilayer web S2. At this time, the first fiber bundle F1 is configured so as to enable a certain degree of slack between the third nip rolls 112 and merging part 132. Due to this, there is the same action as if dancer rollers were provided between them.

In the method of production according to the present embodiment, the second melt bonded part forming device 134 is used to melt bond the substrate sheet 12, holding sheet 13, and first fiber bundle F1 included in the multilayer web S2 whereby two second melt bonded parts 11 (FIG. 3) are respectively formed in a row. Due to this, the multilayer web S2 is melt bonded across its thickness direction. The second melt bonded part forming device 134, for example, is a heat seal device, ultrasonic wave sealing device, etc. In the method of production according to the present embodiment, a heat seal device is used.

After this, at the multilayer web S2, a second fiber bundle F2 to fourth fiber bundle F4 which are opened by the same method as the first fiber bundle F1 are successively overlaid whereby a multilayer web S3 is formed.

On the other hand, the nonwoven fabric 151 which forms the sheet with slits 7 is continuously unrolled from a nonwoven fabric roll 150. The nonwoven fabric 151 is passed through dancer rolls 152 and then intermittently conveyed and, further, passes through gather rolls 154. The gather rolls 154 have continuous sawtooth shaped blades (not shown) at their surfaces in their peripheral directions. Due to this, the nonwoven fabric 151 which passes the gather rolls 154 is formed with sawtooth shaped slits (not shown). Due to the above, the sheet with slits 7 is formed from the nonwoven fabric 151.

The sheet with slits 7 merges with the multilayer web S3 at the merging part 156 to form the multilayer web S4.

In the method of production according to the present embodiment, the first melt bonded part forming device 158 is used to melt bond the multilayer web S4 as a whole whereby the multilayer web S4 is formed with the first melt bonded part 8 (see FIG. 3 etc.). Due to this, the multilayer web S4 is melt bonded across its thickness direction. The first melt bonded part forming device 154 is, for example, a heat seal device, ultrasonic wave sealing device, etc. In the method of production according to the present embodiment, a heat seal device is used.

The multilayer web S4 which has passed the first melt bonded part forming device 158 is cut by a cutting device 160 whereby the cleaning member 1 is produced. The present invention is mainly an invention relating to this cutting device 160. Embodiments of this cutting device 160 will be explained later in detail.

The cleaning member 1 which is produced by the method of production according to the present embodiment includes a sheet with slits 7, but a cleaning member which is produced by a method of production according to another embodiment does not include a sheet with slits.

Further, in the cleaning member 1 which is produced by the method of production according to the present embodiment, the receiving parts 14 are positioned at the surface of the cleaning member 1. In the method of production of a cleaning member according to another embodiment, by changing the order of overlay of the substrate sheet 12 and the holding sheet 13 as well as the fibrous members 3 to 6, the receiving parts 14 are arranged between any adjoining fibrous members 3 to 6. Due to this, the two surfaces of the cleaning member 1 can be used for cleaning. At this time, to facilitate insertion of the insert parts 16 into the receiving parts 14, the dimensions of the substrate sheet 12 and the holding sheet 13 in the long direction (up-down direction of FIG. 3) are preferably made longer than the fibrous members 3 to 6. These dimensions can be freely determined. Further, at this time, the sheet with slits 7 need not be used or two sheets with slits 7 may be arranged at the two surfaces of the cleaning member 1.

(First Embodiment of Cutting Device)

From here, FIG. 5 to FIG. 7D will be used to explain a first embodiment of the cutting device 160. First, the multilayer web S4 before being cut by the cutting device 160 will be explained.

Figure 5:
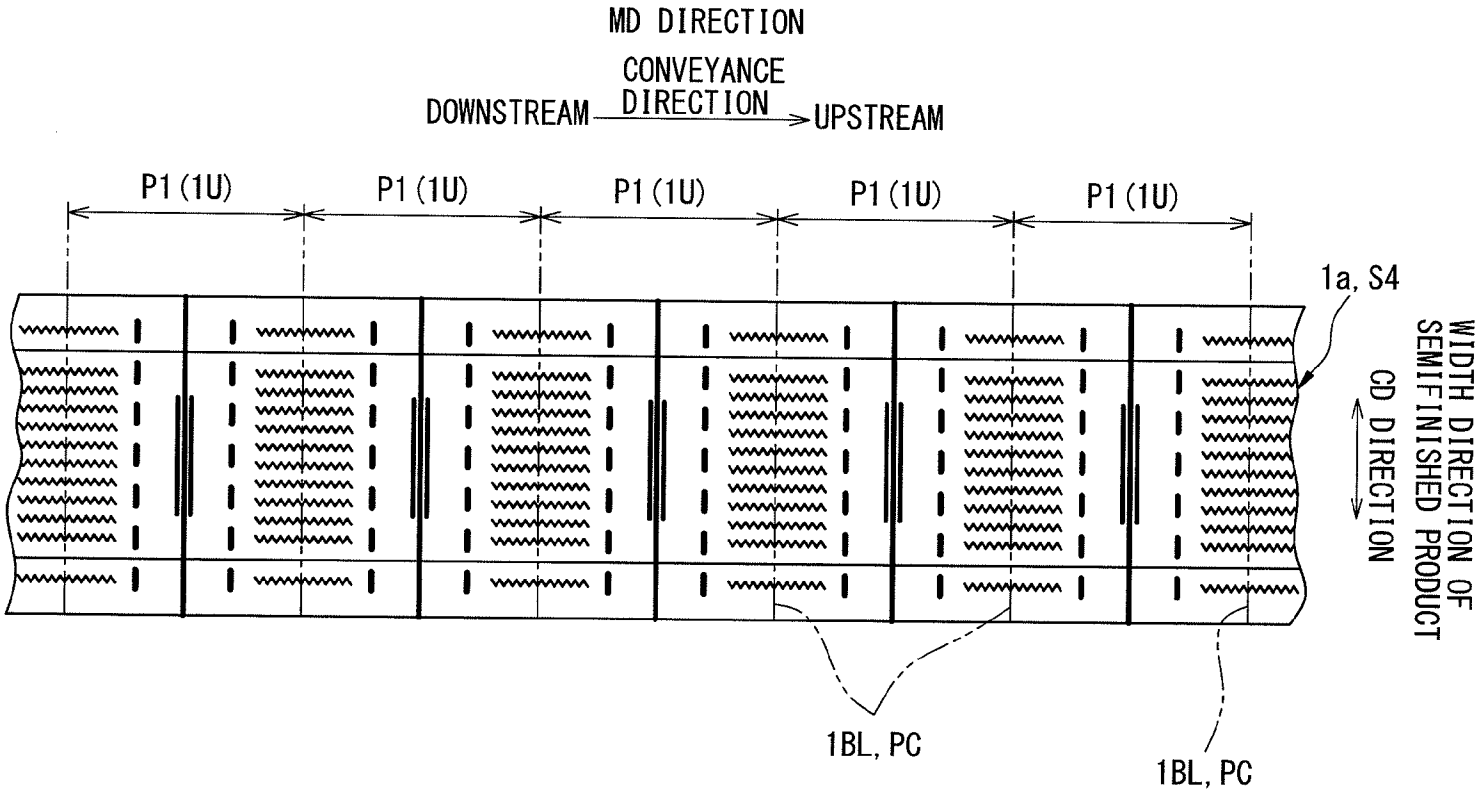
FIG. 5 is a schematic view of a semifinished product in a state before cutting out a cleaning member.

Such a multilayer web S4 (corresponding to web member) is cut to desired widths by the cutting device 160 which is provided at the substantial final step in the production process. FIG. 5 is a schematic view which shows the state before cutting the multilayer web S4. At this point of time, all component parts 3, 4, 5, 6, 7, 12, and 13 of the cleaning member 1, for example, the substrate sheet, fibrous members, etc. are already overlaid and integrally melt bonded, but are still not split into the individual cleaning members 1. That is, the multilayer web S4 is in a state of the web 1*a* where the parts 1U, 1U . . . corresponding to the cleaning members 1, 1 . . . are continuously aligned along the machine direction of the production line. More specifically, the holding sheet 13, substrate sheet 12, and sheet with slits 7 are respectively in the states of continuous sheets which continue in the machine direction. Further, the fibrous members 3, 4, 5, 6 are also in the states of belt-shaped fiber bundles F1 to F4 continuing in the machine direction. Below, the web 1*a* according to this cleaning member 1 will be referred to as the "semifinished product 1*a*", and the part 1U corresponding to a cleaning member 1 in the semifinished product 1*a* will also be referred to as a "unit semifinished product 1U".

Further, in an embodiment of the above-mentioned method of production, this semifinished product 1*a* is conveyed by a mode of conveyance, so-called "lateral flow". That is, it is conveyed in the state with the direction corresponding to the width direction of the cleaning members 1 facing the machine direction. Accordingly, the cut end parts which are formed by cutting the semifinished product 1*a* in the machine direction by the product pitch P1 become the end parts of the cleaning members 1 in the width direction. Note that, as clear from the above, in this semifinished product 1*a*, the fiber extending direction of the fiber bundles F1 to F4 which form the fibrous members 3, 4, 5, 6 run along the machine direction, so when cutting the product by the above-mentioned product pitch P1, the fiber bundles F1 to F4 are also cut.

From here, the cutting device 160 will be explained, but in the following explanation, the width direction of this semifinished product 1*a* will be also referred to as the "CD direction" and, further, in the two direction perpendicularly intersecting this CD direction, the direction in which the semifinished product 1*a* continues will be also referred to as the "MD direction". Note that, the "MD direction" is also the machine direction of the semifinished product 1*a*. Furthermore, the three of the thickness direction of the semifinished product 1*a*, the CD direction and the MD direction are perpendicular to each other.

Figure 6A:
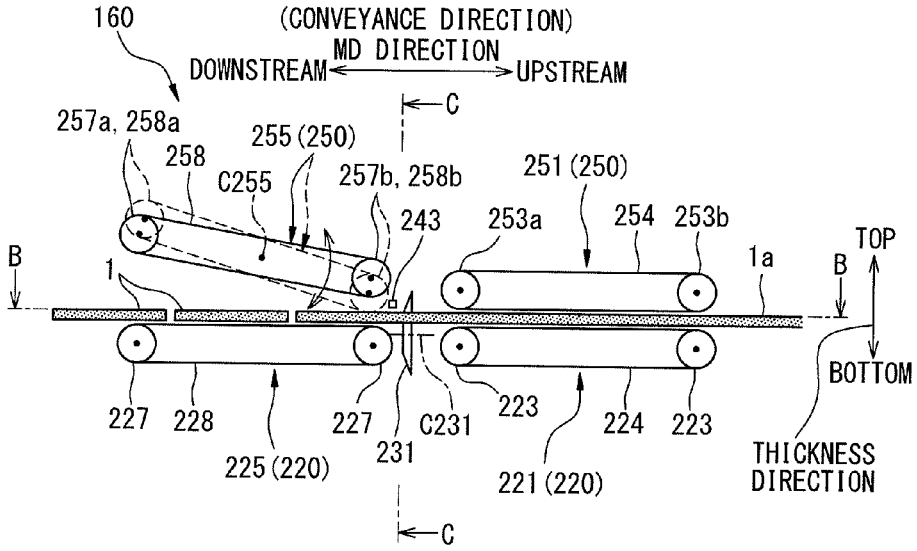
FIG. 6A is a schematic side view of a cutting device according to a first embodiment of the present invention.
Figure 6B:
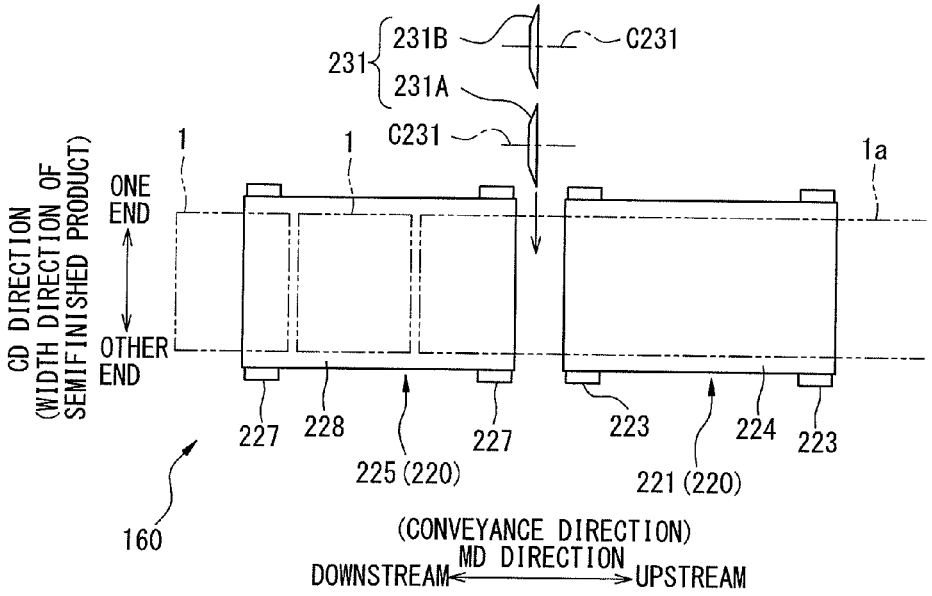
FIG. 6B is a view along the arrow mark B-B of FIG. 6A.
Figure 6C:
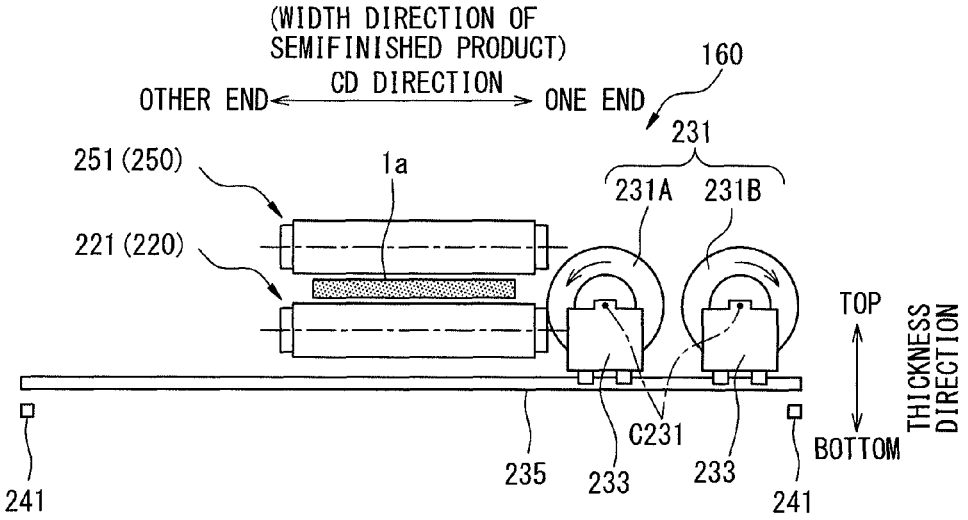
FIG. 6C is a view along the arrow mark C-C of FIG. 6A.

FIG. 6A is a schematic side view of a cutting device 160 according to the first embodiment, FIG. 6B is a view along the arrow B-B in FIG. 6A, and FIG. 6C is a view along the arrow C-C in FIG. 6A. The cutting device 160 has an intermittent conveyance mechanism 220 which intermittently conveys the semifinished product 1*a* (corresponding to web member), two rotary blades 231 (231A, 231B) which are arranged so as to be substantially aligned in the CD direction and which are driven to rotate in mutually opposite directions to cut the semifinished product 1*a* while a semifinished product 1*a* stops being conveyed, a limiting member 250 which limits movement of the semifinished product 1*a* while the rotary blades 231 are cutting the semifinished product 1*a*, various sensors 241, 243 which monitor the states of equipment 220, 231, 250, for example, the intermittent conveyance mechanism 220, etc., and a control unit (not shown). Further, based on detection signals which are transmitted from said sensors 241, 243, etc., the control unit controls the operations of the intermittent conveyance mechanism 220, rotary blades 231, limiting member 250, etc. so that the semifinished product 1*a* is successively cut at the product pitch P1 and individual cleaning members 1 are produced.

The intermittent conveyance mechanism 220 includes, for example, two belt conveyors 221, 225 which are arranged aligned in the MD direction. Specifically, one belt conveyor 221 is arranged at a position at an upstream side in the MD direction from the position of installation of the rotary blades 231. Further, another belt conveyor 225 is arranged at a position at a downstream side in the MD direction from the position of installation of the rotary blades 231. Below, the former will be called the "upstream side belt conveyor 221", while the latter will be called "the downstream side belt conveyor 225".

The upstream side belt conveyor 221 and the downstream side belt conveyor 225 have pairs of rollers 223, 227 which are arranged aligned in the MD direction and endless belts 224, 228 which are strung on the pairs of rollers 223, 227. Further, at least one of the rollers 223, 227 among the pairs of rollers 223, 227 are driven to rotate by a drive source, for example, a servo motor. Due to this, the outer circumferential surfaces of the endless belts 224, 228 are used as conveyor surfaces for conveying the semifinished product 1*a* downstream in the MD direction. However, the rollers 223, 227 are not limited to pairs. In another embodiment, three rollers are provided whereby the endless belt is made to circle in a substantially triangular shaped peripheral path.

Further, these belt conveyors 221, 225 perform substantially the same intermittent conveyance operations linked together. Due to this, the semifinished product 1*a* is conveyed in the MD direction up to the cutting position of the rotary blade 231.

The conveyance is stopped in the intermittent conveyance operation by, for example, a rotary encoder or other rotation detection sensor measuring the amount of conveyance of the semifinished product 1*a*. The rotation detection sensor is, for example, provided at either of the rollers 223, 227 of the above-mentioned belt conveyors 221, 225. Such a sensor repeatedly outputs a signal of the rotational angle value corresponding to an amount of conveyance equivalent to one unit semifinished product 1U serving as the product pitch P1. Further, the conveyance of the semifinished product 1*a* is stopped at the point of time when a rotational angle value matching with the target rotational angle value is output. Here, the above-mentioned target rotational angle value is determined in advance, for example, so that when conveyance is stopped, the cutting positions PC at the semifinished product 1*a*, that is, the boundary positions 1BL of unit semifinished products 1U adjoining each other in the MD direction (FIG. 5) are aligned with the cutting positions of the rotary blades 231 in the MD direction. Due to this, the semifinished product 1*a* is cut at boundary positions 1BL of the unit semifinished products 1U. Note that, it is possible to use a CCD camera etc. to obtain an image, analyze it to measure the positional deviation from the target stop position of the semifinished product 1*a* at the time of stopping conveyance, and use this positional deviation as the basis to correct the above-mentioned target rotational angle value. Further, conveyance of the semifinished product 1*a* is resumed linked with, for example, the above-mentioned limiting member 250.

The two rotary blades 231 (231A, 231B) respectively have round-shaped disks as main bodies over the entire circumferential edges of which sharp cutting edges are formed. Further, these rotary blades 231 are respectively provided integrally with rotary shafts C231 which are concentric with their centers and which extend in the MD direction. Said rotary shafts C231 are supported by support tables 233 through not shown bearings etc. Further, the support tables 233 are provided with not shown motors as drive sources which drive rotation of the rotary blades 231 about said rotary shafts C231. Accordingly, the rotational forces of the motors are transmitted to the corresponding rotary blades 231 by wrapped transmission mechanisms or other suitable power transmission mechanisms (not shown). Due to this, the rotary blades 231 are respectively driven to rotate at predetermined peripheral velocities in predetermined directions.

These rotary blades 231 are guided, together with support tables 233 supporting them, by a linear guide or other suitable guide member 235 so as to be able to move back and forth in the CD direction (corresponding to crossing direction). Further, a suitable not shown drive mechanism is used to make these rotary blades 231 move back and forth in the CD direction. The amounts of outward and inward strokes respectively relating to the back and forth movement are set so that the rotary blades 231 cross the CD direction across the entire width of the semifinished product 1*a*. Further, said not shown drive mechanism has, for example, a pair of pulleys which are arranged aligned in the CD direction, an endless timing belt which is strung on the pair of pulleys, and a servo motor acting as drive source for rotating the pulley. Further, the support tables 233 are fastened to parts of the endless timing belts. Accordingly, by the servo motor repeatedly operating forward and in reverse rotations, the rotary blade 231 is made to move back and forth in the CD direction.

Further, while the semifinished product 1*a* has stopped being conveyed, the rotary blades 231 are driven to rotate about the corresponding rotary shafts C231 while moving from one side to the other side in the CD direction and next moving from the other end side to one end side in the CD direction. As a result, during movement of the rotary blades 231 in the CD direction, the semifinished product 1*a* is cut by the cutting edges of the rotary blades 231 driven to rotate. Below, the movement from one end side to the other end side will be referred to as "outward movement", while the movement from the other end side to the one end side will be referred to as "inward movement".

In the first embodiment according to the cutting device 160, the rotary blade 231A is driven to rotate in the counterclockwise direction in FIG. 6C, while the rotary blade 231B is driven to rotate in the clockwise direction in FIG. 6C. Due to this, when the rotary blades 231A, 231B move outward, the rotary blade 231A performs a so-called "down cut", that is, cuts the semifinished product 1*a* from the top direction toward the bottom direction of its thickness direction (regarding direction, see FIG. 6A and FIG. 6C), while the rotary blade 231B performs a so-called "up cut", that is, cuts the semifinished product 1*a* from the bottom direction toward the top direction of its thickness direction. Conversely, when the rotary blades 231A, 231B engage in inward movement, the rotary blade 231A cuts the semifinished product 1*a* by an up cut, then the rotary blade 231B cuts the semifinished product 1*a* by a down cut.

In turn, when the rotary blades 231 are moving outward, the rotary blade 231A cuts the semifinished product 1*a* first, that is, before the rotary blade 231B, while when the rotary blades 231 are moving inward, the rotary blade 231B cuts the semifinished product 1*a* first, that is, before the rotary blade 231A. Therefore, the semifinished product 1*a* is cut by the rotary blade 231 first by a down cut, then is cut by an up cut. The action of this cutting step will be explained later.

Incidentally, near the stroke end at one end side in the CD direction and near the stroke end at the other end side, proximity switches 241 are respectively provided. Further, the proximity switches 241 detect when the rotary blades 231 move across the semifinished product 1*a* in the CD direction and reach the stroke ends, and output detection signals. Further, the detection signals which are output from these sensors 241 are, for example, sent to the control unit (not shown) and used for control of the limiting member 250.

The limiting member 250 has an upstream side pushing member 251 which is arranged corresponding to the upstream side belt conveyor 221 and a downstream side pushing member 255 which is arranged corresponding to the downstream side belt conveyor 225. Further, the upstream side pushing member 251 pushes the semifinished product 1*a* against the upstream side belt conveyor 221 at a position at the upstream side of the rotary blades 231 in the MD direction while the semifinished product 1*a* is being cut, while the downstream side pushing member 255 pushes the semifinished product 1*a* against the downstream side belt conveyor 225 at a position at the downstream side of the rotary blades 231 in the MD direction while the semifinished product 1*a* is being cut (see dotted line in FIG. 6A). Due to this, movement of the semifinished product 1*a* at the time of cutting is effectively limited and as a result good cuttability is secured through improvement of the stability of the cutting operation.

The upstream side pushing member 251 has a pair of rollers 253*a*, 253*b* which are arranged in the MD direction and an endless belt 254 strung along a pair of rollers 253*a*, 253*b*. This endless belt 254 is arranged so that the surface at the side abutting against the semifinished product 1*a* faces the outer circumferential surface forming the conveyance surface of the endless belt 224 of the upstream side belt conveyor 221. These endless belts 224, 254 slightly grip the semifinished product 1*a* which is positioned between the outer circumferential surfaces from the two sides of the thickness direction. Further, the endless belt 254 of the upstream side pushing member 251 is interlocked with the intermittent conveyance operation of the upstream side belt conveyor 221 while engaging in an intermittent circling operation by the same operation pattern as the intermittent conveyance operation. Accordingly, the semifinished product 1*a* is intermittently, stably conveyed in the MD direction by amounts of conveyance of the product pitch P1, while when the rotary blades 231 cut the semifinished product 1*a* when conveyance is stopped, movement of the semifinished product 1*a* is effectively limited at a position at the upstream side from the rotary blade 231 in the MD direction, and due to this, good cuttability is secured.

The circling operation of the upstream side pushing member 251 which is linked with this intermittent conveyance operation is, for example, realized by obtaining drive force of this circling operation from a servo motor serving as the drive source of the upstream side belt conveyor 221 through a gear train, wrapped transmission mechanism, or other suitable power transmission mechanism, but the invention is not limited to these. In another embodiment, a servo motor is separately provided for driving circling operation of the upstream side pushing member 251 and said servo motor is controlled synchronized with the intermittent conveyance operation of the upstream side belt conveyor 221.

On the other hand, the downstream side pushing member 255 also, like the above-mentioned upstream side pushing member 251, has a pair of rollers 257*a*, 257*b* which are arranged aligned in the MD direction and an endless belt 258 which is strung around the pair of rollers 257*a*, 257*b*. Further, the outer circumferential surface of the endless belt 258 at the side abutting against the semifinished product 1*a* is arranged so as to face the outer circumferential surface of the endless belt 228 of the downstream side belt conveyor 225. However, the endless belt 258 of the downstream side pushing member 255 is supported rockably about an axis C255 which extends in the CD direction. Further, when cutting the semifinished product 1*a*, by rotating in the counterclockwise direction in FIG. 6A, as shown by the dotted line in the figure, the upstream end part 258*b* of the endless belt 258 in the MD direction abuts against the semifinished product 1*a*, whereby said semifinished product 1*a* is pushed toward the outer circumferential surface of the endless belt 228 of the downstream side belt conveyor 225. Due to this, the movement of the semifinished product 1*a* at the time of cutting is limited at the downstream side of the rotary blades 231 as well whereby good cuttability is secured. On the other hand, at the time of conveyance, by rotating clockwise in FIG. 6A, as shown by the solid line in the figure, the upstream end part 258*b* in the endless belt 258 separates from the endless belt 228 of the downstream side belt conveyor 225 from the above-mentioned pushing state (dotted line state) and reaches a retracted state. Due to this, the clearance between the downstream side belt conveyor 225 and the downstream side pushing member 255 is expanded more and the semifinished product 1*a* is prevented from becoming caught at the time of conveyance.

The drive mechanism of this rocking operation is not shown, but, for example, a configuration which has a drive source constituted by a servo motor and a crank mechanism or other motion conversion mechanism which converts rotary operation of the rotary shaft of the servo motor to a back and forth movement operation and transmits it to the downstream side pushing member 255 may be illustrated. Further, in this example, this configuration is used, but the invention is not limited to this in any way. Further, in this example, to detect the pushed state, a proximity switch 243 is provided at a position near the downstream side pushing member 255 in the pushed state. The detection signal of this proximity switch 243 is used as a trigger signal of the start of the movement operation of the rotary blades 231 in the CD direction.

Further, the endless belt 258 of the downstream side pushing member 255 is interlocked with the intermittent conveyance operation of the downstream side belt conveyor 225 and engages in an intermittent circling operation by substantially the same operation pattern as this intermittent conveyance operation. Accordingly, the trouble of the semifinished product 1*a* being conveyed getting caught on the endless belt 258 of the downstream side pushing member 255 is more reliably prevented. This circling operation of the endless belt 258 of the downstream side pushing member 255 is performed by a servo motor constituted as a drive source which is provided at least at one of the rollers of the pair of rollers 257*a*, 257*b*. The servo motor is controlled by a control unit. The control unit controls the servo motor based on for example the output of an encoder or other rotation detection sensor which is provided at any of the rollers 223, 227 of the intermittent conveyance mechanism 220. Due to this, intermittent circling operation of the endless belt 258 of the downstream side pushing member 255 which is linked with the above-mentioned intermittent conveyance operation is realized.

Furthermore, in the embodiment of FIG. 6A, even during conveyance of the semifinished product 1*a*, the outer circumferential surface of the endless belt 258 of the downstream side pushing member 255 maintains a state inclined with respect to the outer circumferential surface of the endless belt 228 of the downstream side belt conveyor 225 (see solid line state in FIG. 6A). That is, the downstream end part 258*a* of the endless belt 258 of the downstream side pushing member 255 is separated from the outer circumferential surface of the downstream side belt conveyor 225 more than the upstream end part 258*b*. Further, due to this, even during conveyance, the clearance between the downstream side belt conveyor 225 and the downstream side pushing member 255 expands toward the downstream side in the MD direction. Accordingly, even if individually the cut cleaning members 1 recover in bulk during conveyance and the thickness increases, the cleaning members 1 are reliably prevented from catching at the downstream side pushing member 255.

While not particularly shown, the control unit is comprised of, for example a computer, a PLC (programmable logic controller), etc. as a main body. This main body has a processor and memory. Further, by reading out and running a control program which is stored in advance in the memory by a processor, the above-mentioned intermittent conveyance mechanism 220, rotary blades 231, and limiting member 250 are made to operate interlocked with each other by control of the servo motors etc. serving as drive sources for these component elements 220, 231, and 250. That is, the configuration of the control unit which is referred to here includes not only the above-mentioned such computer, PLC, etc., but also an amplifier for actual positional control of the servo motor etc.

From here, the action of the cutting device 160 according to the first embodiment which is used in the method of production according to the above-mentioned embodiment will be explained. Said cutting device 160 mainly differs from the cutting device according to PTL 1 in the point two rotary blades 231 are provided and these rotate in mutually opposite directions.

Figure 7A:
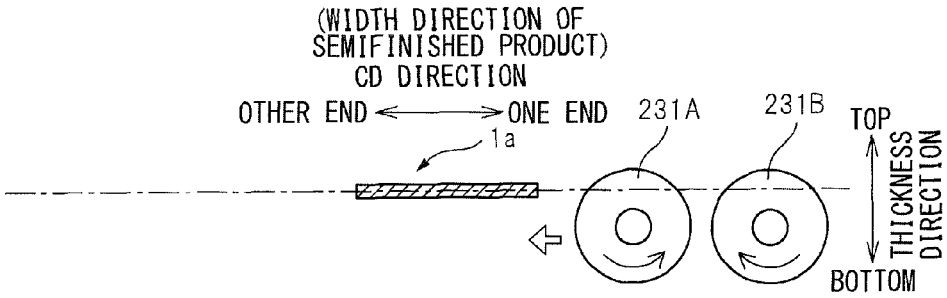
FIG. 7A is an explanatory view which shows the action of a cutting device according to the first embodiment of the present invention.

FIGS. 7A to 7D are explanatory views for explaining the action of the cutting device 160 at the viewpoint of FIG. 6C at the time of cutting the semifinished product 1*a*. FIGS. 7A to 7D show only the rotary blades 231A, 231B and semifinished product 1*a*. Note that, in FIG. 7A, the directions are shown, while in FIGS. 7B to 7D, they are not shown, but it should be noted that the indication of directions described in FIG. 7A is used in common in FIGS. 7B to 7D as well.

FIG. 7A shows the state where the rotary blades 231A, 231B are at the stroke end at one end side of the semifinished product 1*a* in the width direction and start outward movement (movement to left side of FIGS. 7A to 7D). Here, as explained above, the rotary blade 231A is driven to rotate in the counterclockwise direction, while the rotary blade 231B is driven to rotate in the clockwise direction.

Figure 7B:
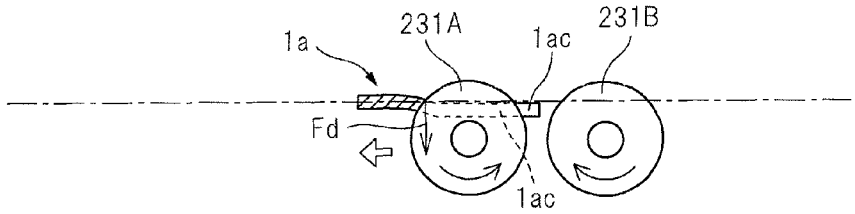
FIG. 7B is an explanatory view which shows the action of a cutting device according to the first embodiment of the present invention.

FIG. 7B shows the state where the rotary blades 231A, 231B start the outward movement and the rotary blade 231A cuts the semifinished product 1*a*. As explained above, the rotary blade 231A down cuts the semifinished product 1*a*, so the semifinished product 1*a* is pushed downward from the top direction in the thickness direction, that is, receives force Fd from the cutting edge of the rotary blade 231A, while cutting. Due to this, despite the fact that movement of the semifinished product 1*a* is effectively limited by the limiting member 250, the cut part of the semifinished product 1*a* is moved downward in the thickness direction and the cut end part 1*ac* at the cut surface of the semifinished product 1*a* is directed slightly downward.

When a cutting device includes a single rotary blade, the cut process ends in this state, so the cut surface ends up facing the bottom side of the semifinished product 1*a* in the thickness direction. As a result, sometimes insufficiently cut fibers appear and the cut surface does not become clean.

Figure 7C:
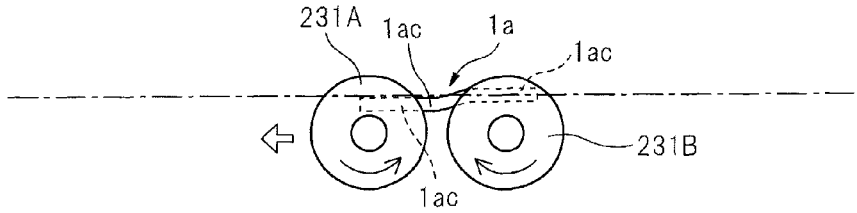
FIG. 7C is an explanatory view which shows the action of a cutting device according to the first embodiment of the present invention.

FIG. 7C shows the state after FIG. 7B where the rotary blade 231B further cuts the semifinished product 1*a*. As explained above, the rotary blade 231B up cuts the semifinished product 1*a*. Due to this, the rotary blade 231B cuts the product as if scraping up the insufficiently cut fibers at the cut end part 1*ac* of the cut surface of the semifinished product 1*a* which face the bottom side in the thickness direction of the semifinished product 1*a* due to the rotary blade 231A.

Figure 7D:
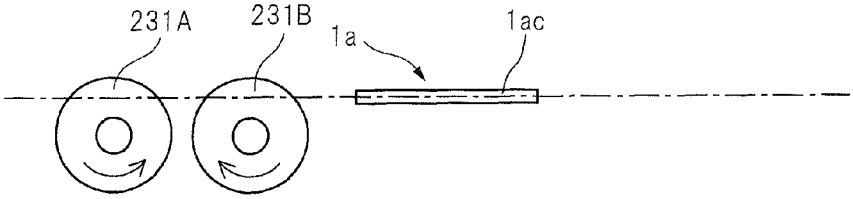
FIG. 7D is an explanatory view which shows the action of a cutting device according to the first embodiment of the present invention.

FIG. 7D shows the state where the rotary blades 231A, 231B are at the stroke ends at the other end side in the width direction of the semifinished product 1*a* and finish their outward movement. As explained above, the semifinished product 1*a* is down cut by the rotary blade 231A and further is then up cut by the rotary blade 231B, whereby the insufficiently cut fibers at the cut end part 1*ac* are cut and reduced in number and the cut surface becomes clean.

Note that, at this time, the fact of the rotary blades 231A, 231B finishing the outward movement is detected by a proximity switch 241 which outputs a detection signal and, for example, sends it to the control unit. Due to this, the operations of the intermittent conveyance mechanism 220, rotary blades 231, limiting member 250, etc. are controlled.

While not particularly shown, when the rotary blades 231A, 231B are engaged in inward movement, the rotary blade 231B which first cuts the semifinished product 1*a* cuts the semifinished product 1*a* by a down cut, then the rotary blade 231A which next cuts it cuts the semifinished product 1*a* by an up cut. Therefore, the actions of the rotary blades 231A, 231B in cutting the semifinished product 1*a* at the time of outward movement and at the time of inward movement can be understood to be the same. Therefore, the cutting device 160 according to the first embodiment does not have to make the rotary blades 231A, 231B move in only one direction of outward movement or inward movement and can give similar action even if made to move back and forth, so the time required for the cutting process can be preferably reduced. However, in another embodiment according to the cutting device, the rotary blades 231 move in only one direction when cutting the semifinished product 1, that is, outward movement or inward movement, then are retracted to height positions not cutting the semifinished product 1*a* and return to the positions before cutting.

Further, the rotary blade 231A which first cuts the semifinished product 1*a* makes a down cut. The substrate sheet 12 and the holding sheet 13 which are formed from nonwoven fabrics are arranged at the bottommost layer of the semifinished product 1*a* in the thickness direction. Further, at the center part of the cleaning member 1 in the width direction, these substrate sheet 12 and holding sheet 13 are not cut, that is, are not continuously cut in the machine direction, but are only cut intermittently (see FIG. 5). Due to this, the substrate sheet 12 and the holding sheet 13 are deformed by the force Fd (FIG. 7B) which is received from the cutting edge of the rotary blade 231A due to the down cut less than the fiber bundles F1 to F4 or the sheet with slits 7 or other members which are cut continuously in the machine direction MD. Due to this, the substrate sheet 12 and the holding sheet 13 support the layers which are positioned above these and ease the action of the cut end part 1*ac* of the cut surface of the semifinished product 1*a* being turned downward. Accordingly, in the method of production of a cleaning member 1 according to the above-mentioned embodiment, like in the cutting device 160 according to the first embodiment, if first cutting by a down cut, then cutting by an up cut, the cut surface of the semifinished product 1*a* and in turn cleaning member 1 can be preferably made cleaner. However, in another embodiment relating to the cutting device, first the product is cut by an up cut, then is cut by a down cut.

Further, in another embodiment relating to the cutting device, three or more rotary blades are arranged substantially aligned in the CD direction. At this time, these rotary blades include a rotary blade which rotates in one direction and a rotary blade which rotates opposite to that whereby the semifinished product 1*a* is cut by both a down cut and an up cut. By such a configuration of rotary blades, the semifinished product 1*a* and in turn the cut surface of the cleaning member 1 can be preferably made cleaner.

Furthermore, in the cutting device 160 according to the first embodiment, the web member cut by the cutting operation by the rotary blades 231 is a semifinished product 1*a* of the cleaning member 1, but if the cut product is a web member which includes a fiber bundle which continuously extends in the machine direction and which is intermittently conveyed in said machine direction, any is possible. For example, the web member may be one, like the embodiment according to the above-mentioned method of production, which includes a nonwoven fabric which extends continuously in the machine direction or may include a woven fabric rather than a nonwoven fabric.

(Second Embodiment of Cutting Device)

Figure 8A:
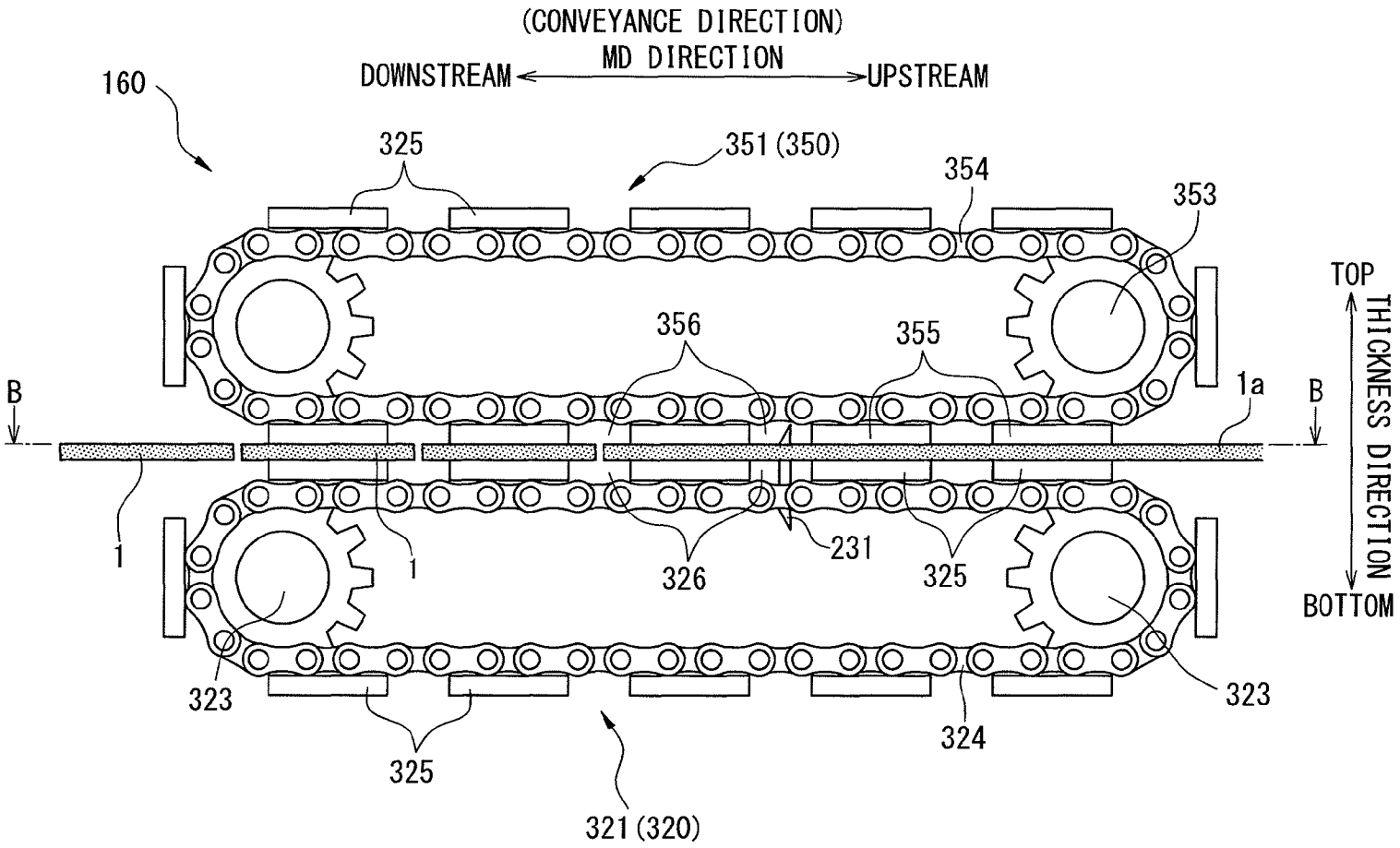
FIG. 8A is a schematic side view of a cutting device according to a second embodiment of the present invention.
Figure 8B:
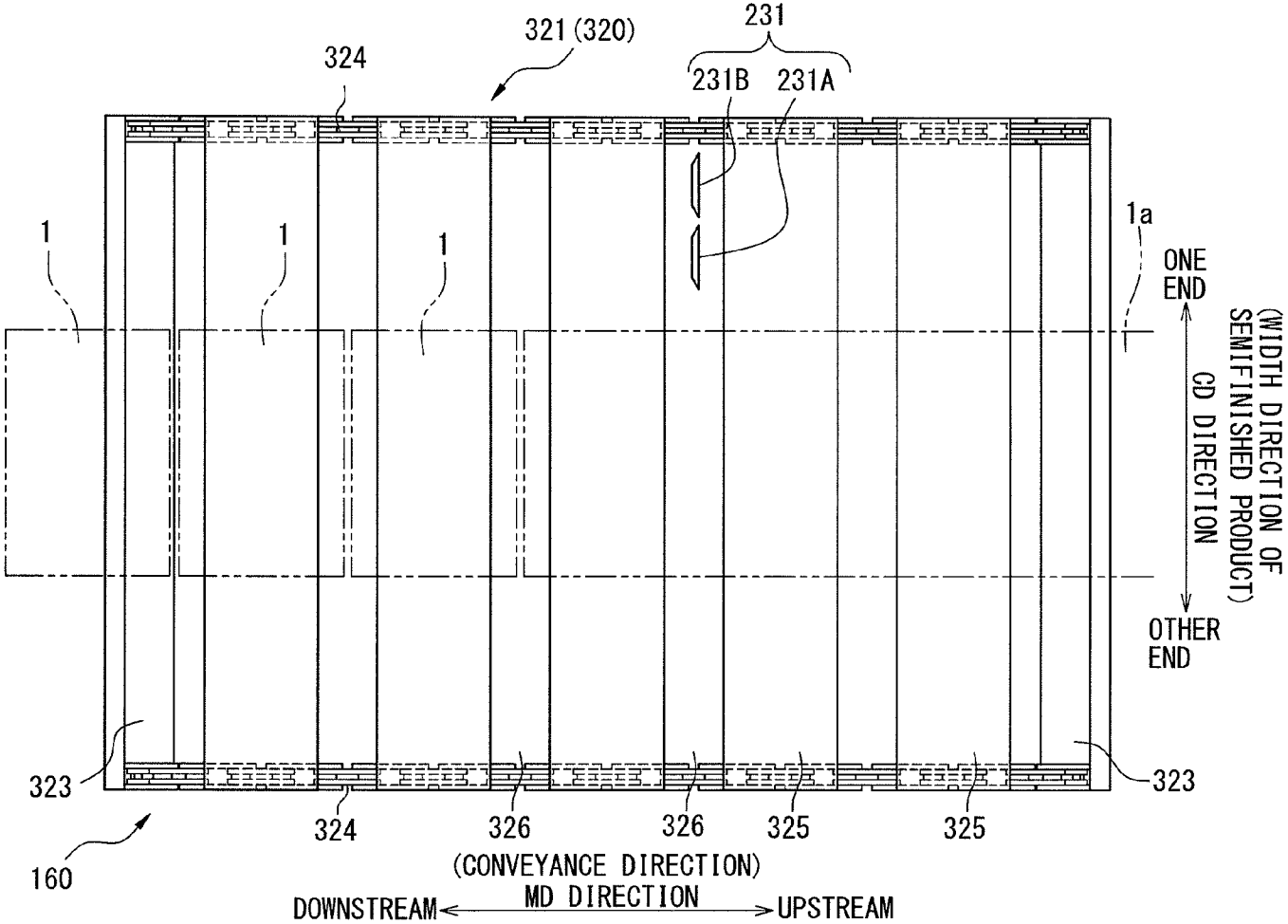
FIG. 8B is a view along the arrow mark B-B of FIG. 8A.

From here, FIG. 8A and FIG. 8B will be used to explain a second embodiment of the cutting device 160. Note that, the second embodiment of the cutting device 160 will be explained only with regard to the points of difference from the first embodiment. The second embodiment of the cutting device 160 differs from the first embodiment in the configuration of the intermittent conveyance mechanism and limiting member.

FIG. 8A is a schematic side view of a cutting device 160 according to a second embodiment of the present invention, while FIG. 8B are views along the arrow B-B in FIG. 8A. FIG. 8A and FIG. 8B are views similar to FIG. 6A and FIG. 6B. In the second embodiment of the cutting device 160, the intermittent conveyor device 320 is the chain conveyor 321 which is arranged in the MD direction from the upstream to downstream side of the position of installation of the rotary blades 231. The chain conveyor 321 has a pair of gear shafts 323 which are arranged along the MD direction, a pair of endless chains 324 which are strung on the gear shafts 323, and a plurality of gripping plates 325 which are attached to these endless chains 324. The endless chains 324 are positioned at the two sides of one end side and the other end side of the semifinished product 1*a* in the width direction. The plurality of gripping plates 325 are attached to both of the endless chains 324. They are provided to extend in the width direction of the semifinished product 1*a* between both of the endless chains 324 and to be separated from each other in the MD direction. Further, at least one gear shaft 223 among the pair of gear shafts 223 is driven to rotate by a drive source, for example, a servo motor. The operation of this drive source is controlled by the control unit (not shown) in the same way as the cutting device 160 according to the first embodiment. Further, a clearance 326 is formed between adjoining gripping plates 325.

Further, in the second embodiment of the cutting device 160, the limiting member 350 is the chain conveyor 251 which has the same configuration as the chain conveyor 321 of the above-mentioned intermittent conveyor device 320. The chain conveyor 351 has a pair of gear shafts 353, a pair of endless chains 354, and a plurality of gripping plates 355. Between the adjoining gripping plates 355, clearances 356 are formed.

Between the chain conveyors 321, 351, the gripping plates 355 of the chain conveyor 351 work together with the gripping plates 325 which face the chain conveyor 321 to grip the semifinished product 1*a*. Due to this, movement of the semifinished product 1*a* at the time of cutting is effectively limited and as a result the stability of the cutting operation is improved and therefore good cuttability is secured.

The chain conveyor 321 of the intermittent conveyor device 320 performs the same operation as the intermittent conveyance operation by the belt conveyors 221, 225 of the cutting device 160 in the first embodiment. Further, the operation of the chain conveyor 351 of the limiting member 350 is controlled by the above-mentioned control unit (not shown) so as to perform an operation the same as the intermittent conveyance operation of the chain conveyor 321 of the intermittent conveyor device 320. As a result, the semifinished product 1*a* which is gripped by the gripping plates 325, 355 between the chain conveyors 312, 351 is intermittently conveyed by increments of the product pitch P1. Further, in the second embodiment of the cutting device 160, the total of the widths of one gripping plate 325, 355 and one clearance 326, 356 (MD direction length) is set in advance to become substantially equal to the product pitch P1.

Note that, in the second embodiment of the cutting device 160, the rotary blades 231 are designed not to interfere with the gripping plates 325, 355 during conveyance of the semifinished product 1*a* by being retracted together with the support table 233 and guide member 235 by a suitable not shown drive mechanism to the bottom side of the semifinished product 1*a* in the thickness direction. The rotary blades 231 are then, after the semifinished product 1*a* is conveyed by the product pitch P1, moved in the top direction of the thickness direction of the semifinished product 1*a* and are arranged at the stroke end of one end side or the other end side of the semifinished product 1*a* in the width direction such as shown in FIG. 7A.

Further, the rotary blades 231 cut the semifinished product 1*a* by engaging in outward movement or inward movement in the above-mentioned clearances 326, 356. The action of the cutting device 160 according to the second embodiment is the same as the first embodiment, so the explanation will be omitted.

The present invention is defined as follows:

(1) A cutting device which cuts a web member, which includes a fiber bundle which extends continuously in a machine direction and which is intermittently conveyed in said machine direction, in a crossing direction which crosses said machine direction, said cutting device having a plurality of disk shaped rotary blades which rotate about rotary shafts which extend along said machine direction while moving in said crossing direction so as to thereby cut said web member when said web member is at a stop, said plurality of rotary blades being arranged so as to be substantially aligned in said crossing direction and including a rotary blade which rotates in one direction and a rotary blade which rotates in the opposite direction.

(2) The cutting device as set forth in (1) wherein said rotary blades are moved back and forth in said crossing direction.

(3) The cutting device as set forth in (1) or (2) which has two rotary blades.

(4) The cutting device as set forth in any one of (1) to (3) wherein said web member is a multilayer web which further includes a belt-shaped nonwoven fabric which continuously extends in said machine direction, said nonwoven fabric is arranged at a bottommost layer of said multilayer web in a state not continuously cut in said machine direction, and said multilayer web is cut first by a down cut when said multilayer web is cut.

(5) A method of producing a cleaning member which includes a fiber bundle, the method including a step of using a cutting device as set forth in any one of (1) to (4) so as to cut said web member which includes a fiber bundle extending in a machine direction.

The present application claims the benefit of the following patent applications, and the entire disclosure of which is incorporated herein by reference:

- Japanese Patent Application No. 2012-115783 filed on May 21, 2012, and US patent application claiming the priority thereof,
- Japanese Patent Application No. 2012-115784 filed on May 21, 2012, and US patent application claiming the priority thereof,
- Japanese Patent Application No. 2012-115785 filed on May 21, 2012, and US patent application claiming the priority thereof,
- Japanese Patent Application No. 2012-289181 filed on Dec. 29, 2012, and US patent application claiming the priority thereof,
- Japanese Patent Application No. 2012-289182 filed on Dec. 29, 2012, and US patent application claiming the priority thereof,
- Japanese Patent Application No. 2012-289174 filed on Dec. 29, 2012, and US patent application claiming the priority thereof,
- Japanese Patent Application No. 2012-289189 filed on Dec. 29, 2012, and US patent application claiming the priority thereof,
- Japanese Patent Application No. 2012-289175 filed on Dec. 29, 2012, and US patent application claiming the priority thereof,
- Japanese Patent Application No. 2012-289188 filed on Dec. 29, 2012, and US patent application claiming the priority thereof,
- Japanese Patent Application No. 2012-289179 filed on Dec. 29, 2012, and US patent application claiming the priority thereof,
- Japanese Patent Application No. 2012-289177 filed on Dec. 29, 2012, and US patent application claiming the priority thereof,
- Japanese Patent Application No. 2012-289184 filed on Dec. 29, 2012, and US patent application claiming the priority thereof,
- Japanese Patent Application No. 2012-289176 filed on Dec. 29, 2012, and US patent application claiming the priority thereof,
- Japanese Patent Application No. 2013-002855 filed on Jan. 10, 2013, and US patent application claiming the priority thereof, as well as,
- Japanese Patent Application No. 2013-002857 filed on Jan. 10, 2013, and US patent application claiming the priority thereof.

Note that, the cleaning member illustrated in each figure is an example of the cleaning members which can be produced using the method of producing a cleaning member and the system of producing a cleaning member according to the present disclosure. The method of producing a cleaning member and the system of producing a cleaning member according to the present disclosure can be used to produce a cleaning member as described in, for example, Japanese Unexamined Patent Publication No. 2000-296083, 2003-265390, 2003-268663, 2004-223692, 2005-046645, 2005-095665, 2005-111284, 2005-137929, 2005-137930, 2005-137931, 2005-144198, 2005-169148, 2005-199077, 2005-230573, 2005-237975, 2006-015164, 2006-034990, 2006-141483, 2007-135774, 2007-209460, 2007-209461, 2007-029136, 2007-111297, 2007-135666, 2007-136156, 2007-159612, 2007-236690, 2008-006260, 2008-119171, and 2007-029135, and the entire disclosure of which is incorporated herein by reference.

The method of producing a cleaning member and the system of producing a cleaning member according to the present disclosure can be used to produce a cleaning member as described in, for example, U.S. Pat. No. 6,554,937B, US2002/148061A, US2003/0000934A, US2004/0149095A, US2005/0005381A, US2005/039285A, US2005/097695A, US2005/097696A, US2005/132521A, US2005/177967A, US2005/188490A, US2005/193513A, US2005/193514A, US2005/198760A, US2006/016035A, US2006/016036A, US2006/101601A, US2009/165230A and US2009/172904A, as well as US2009/049633A, US2009/255078A and US2010/154156A, and the entire disclosure of which is incorporated herein by reference.

REFERENCE SIGNS LIST

1 cleaning member

1*a* semifinished product (of the cleaning member) (web member)

160 cutting device
231, 231A, 231B rotary blade
C231 rotary shaft
CD crossing direction
F1, F2, F3, F4 fiber bundle
MD machine direction
S4 multilayer web (web member)

The invention claimed is:

1. A cutting device which cuts a web member, which includes a fiber bundle which extends continuously in a machine direction and which is intermittently conveyed in said machine direction, in a crossing direction which crosses said machine direction, said cutting device having a plurality of disk shaped rotary blades which rotate about rotary shafts which extend along said machine direction while moving in said crossing direction so as to thereby cut said web member when said web member is at a stop, said plurality of rotary blades being arranged so as to be substantially aligned in said crossing direction and including a rotary blade which rotate in one direction and a rotary blade which rotate in the opposite direction.

2. The cutting device as set forth in claim 1 wherein said rotary blades are moved back and forth in said crossing direction.

3. The cutting device as set forth in claim 1 which has two rotary blades.

4. The cutting device as set forth in claim 1 wherein said web member is a multilayer web which further includes a belt-shaped nonwoven fabric which continuously extends in said machine direction, said nonwoven fabric is arranged at a bottommost layer of said multilayer web in a state not continuously cut in said machine direction, and said multilayer web is cut first by a down cut when said multilayer web is cut.

5. A method of producing a cleaning member which includes a fiber bundle, the method including a step of using a cutting device as set forth in claim 1 so as to cut said web member which includes a fiber bundle extending in a machine direction.

* * * * *